US007032293B2

(12) United States Patent
Bausch

(10) Patent No.: US 7,032,293 B2
(45) Date of Patent: Apr. 25, 2006

(54) PROCESS FOR PRODUCING BUNDLES OF LAMINATED SHEET METAL FOR MAGNET CORES

(75) Inventor: Günther Bausch, Vaihingen/Enz (DE)

(73) Assignee: Dr. Karl Bausch GmbH & Co. KG, Vaihingen (DE)

( * ) Notice: Subject to any disclaimer, the term of this patent is extended or adjusted under 35 U.S.C. 154(b) by 381 days.

(21) Appl. No.: 10/339,661

(22) Filed: Jan. 9, 2003

(65) Prior Publication Data

US 2003/0172783 A1 Sep. 18, 2003

(30) Foreign Application Priority Data

Jan. 10, 2002 (DE) ..... 102 00 775

(51) Int. Cl.
*G11B 5/127* (2006.01)
*H04R 31/00* (2006.01)

(52) U.S. Cl. ..... 29/603.01; 29/736; 29/738; 29/742; 29/759; 29/760; 29/607; 29/609; 72/379.2; 72/404

(58) Field of Classification Search ..... 29/736, 29/738, 742, 759, 760, 603.01, 607, 609; 72/379.2, 404
See application file for complete search history.

(56) References Cited

U.S. PATENT DOCUMENTS 4,586,236 A * 5/1986 Jones ..... 29/564.6
4,728,382 A * 3/1988 Raschbichler ..... 156/264
5,771,565 A * 6/1998 Walters ..... 29/596
6,588,093 B1 * 7/2003 Emmerich et al. ..... 29/609

FOREIGN PATENT DOCUMENTS

DE 197 41 364 4/1999
JP 58148419 A * 9/1983

OTHER PUBLICATIONS

"Cast thin amorphous metal for stacked core power transformers"; Lin, K.C.; Zook, E.E.; Electrical Electronics Insulation Conference, 1989. Chicago '89 EEIC/ICWA Exposition., Proceedings of the 19th, Sep. 25–28, 1989; pp.: 154–157.*

* cited by examiner

*Primary Examiner*—Paul D Kim
(74) *Attorney, Agent, or Firm*—Pauley Petersen & Erickson

(57) ABSTRACT

A process for producing bundles of laminated sheet metal for magnet cores, wherein laminations are punched free along two longitudinal edges of a sheet metal strip, at least two sheet metal laminations of a magnet core are of a different width extending from one longitudinal edge to the other, and several laminations, which rest against each other, are connected with each other to form the bundle. To simplify the tool control, the two longitudinal edges of a lamination are punched in edge cutting stations, which are separate from each other and are arranged offset in the feed direction of the sheet metal strip. The edge cutting stations for cutting the longitudinal edges have a cutting die and an associated bottom die. The cutting die, together with the bottom die, is displaced for creating different laminate widths.

15 Claims, 1 Drawing Sheet

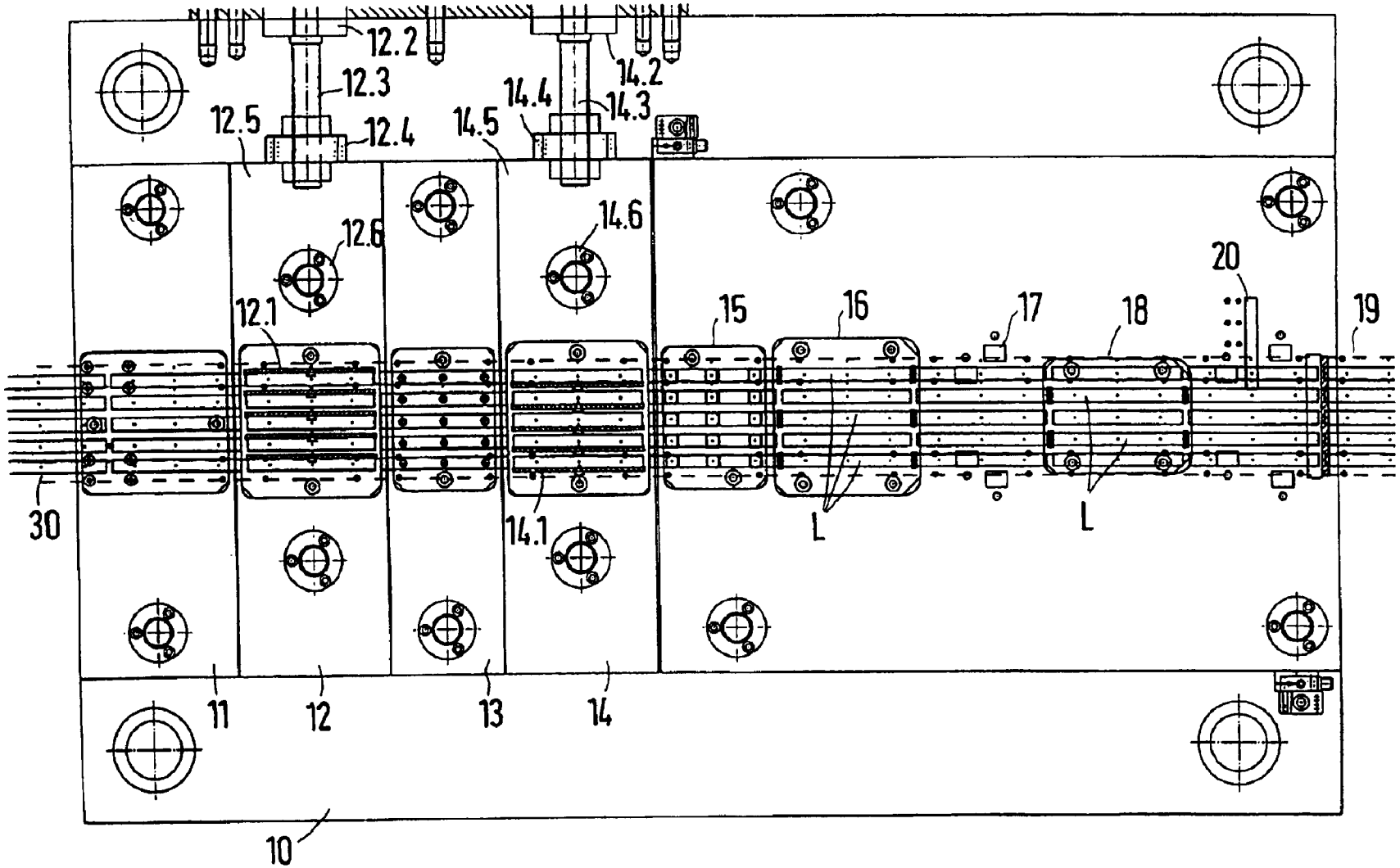
19
20
18
L
17
16
L
15
14.2
14.3
14.6
14
14.4
14.1
14.5
13
12.2
12.3
12.4
12.6
12
12.1
10
12.5
11
30

PROCESS FOR PRODUCING BUNDLES OF LAMINATED SHEET METAL FOR MAGNET CORES

BACKGROUND OF THE INVENTION

1. Field of the Invention

This invention relates to a process for producing bundles of laminated sheet metal for magnet cores, wherein laminations are punched free along two longitudinal edges of a sheet metal strip, at least two laminations of a magnet core are of a different width extending from one longitudinal edge to the other longitudinal edge, and several laminations, which rest against each other, are connected with each other to form the bundle.

2. Discussion of Related Art

A process for producing bundles is known from German Patent Reference DE 197 41 364 A1. Bundles made of sheet metal laminations are described there, which are employed in electromagnetic apparatus, for example impeders, transformers, drive mechanisms, and the like.

Individual laminations are stamped out of a sheet metal strip and are stacked on top of each other. Connecting the laminations is performed by a known packing method. With the process described in German Patent Reference DE 197 41 364 A1 it is intended to produce magnet cores of an approximately round cross section. Thus the width of the sheet metal laminations is varied. One or several sheet metal laminations with dimensions of the greatest width are positioned in the area of the center of the round cross section. For producing the geometry of the changing sheet metal laminations, a variable punching station is installed in a follow-on tool, which cuts the longitudinal edges of the sheet metal laminations. The cutting dies of this station can be adjusted, together with the bottom dies, by synchronous drive mechanisms.

A large control and positioning cost outlay is required, in particular in connection with tools in which several sheet metal laminations are punched in a single stroke.

SUMMARY OF THE INVENTION

It is one object of this invention to provide a process of the type mentioned above but in which the production of the variable widths of the sheet metal laminations is possible with a reduced technical cost outlay for the tool and with a high degree of accuracy.

This object is achieved with two longitudinal edges of a lamination punched in edge cutting stations, which are separate from each other and are arranged offset in a feed direction of the sheet metal strip. The edge cutting stations for cutting the longitudinal edges have a cutting die and an associated bottom die, and the cutting die, together with the bottom die, is displaced for creating different lamination widths.

Because there is a separation of the working of the longitudinal edges, the synchronization cost outlay for the exactly aligned displacement of the cutting dies and bottom dies is considerably reduced. It is thus possible to provide a clearly simplified mechanical tool arrangement. In particular, this is also improved because the cutting die is coupled with the bottom die, and they are displaced as a unit.

The fixed association of the cutting die and the bottom die makes alignment of these two parts of the tools unnecessary.

This embodiment of the tools is particularly advantageous when processing several laminations simultaneously in an edge cutting station. In this case the synchronization cost outlay is not at all, or is only slightly, increased.

In one preferred embodiment of this invention, through-holes for the formation of sheet metal pieces are punched out of some of the laminations in a follow-on perforating device between the two edge cutting stations. The sheet metal separation pieces are used for separating the produced bundles.

For continuously providing an exactly fitting alignment of the sheet metal laminations in the various processing stations of the follow-on tool, a follow-on perforating device is provided upstream of the edge cutting stations, in which locator perforations are punched out.

For combining the sheet metal laminations in the packing process, in a stamping unit depressions are punched out of a predetermined number of laminations, which protrude in the form of nipples on the side of the sheet metal piece opposite the side with the depressions.

The nipples of a sheet metal lamination are then pressed into the depressions of the adjoining sheet metal lamination in a manner of a snap fastener. When using sheet metal separation pieces, the nipples of the end lamination are inserted into the through-holes of the sheet metal separation pieces.

For punching the sheet metal laminations completely out of the sheet metal strip, in one variation of this invention the laminations are punched out of the sheet metal strip in the edge cutting stations of downstream-connected transverse stamping presses, wherein the transverse stamping presses each cut a transverse edge connecting the longitudinal edges.

BRIEF DESCRIPTION OF THE DRAWING

This invention is explained in greater detail in view of an exemplary embodiment represented in the drawing.

The single drawing shows a follow-on tool in horizontal section.

DESCRIPTION OF PREFERRED EMBODIMENTS

The follow-on tool has a base plate 10 on which several processing stations are installed. A sheet metal strip 30 is conducted through the processing stations, out of which sheet metal laminations are punched.

A follow-on perforating device 11 is arranged at the entry into the follow-on tool, which punches locator holes out of the sheet metal strip 30. The locator holes are subsequently used for positioning and aligning the sheet metal strip 30 in the follow-on stations. Thus, position pins engage the locator holes in each cycle of the machine. Following the follow-on perforating device 11, the sheet metal strip 30 reaches an edge cutting station 12, where the longitudinal edges of the sheet metal laminations which are on the left in the feed direction are punched out. The edge cutting station 12 has a lower bottom die support 12.5. An upper element is connected with guide columns 12.6. The upper element supports five punching dies 12.1. The upper element and the bottom die support 12.5 form a carriage which can be displaced transversely with respect to the feed direction of the sheet metal strip 30. The carriage is connected to a motor 12.2 via a coupling bearing 14.4 and an adjusting spindle 12.3. The carriage can be displaced by the drive mechanism. In this case the bottom die and the punching dies 12.1 are positioned, fixed with respect to each other, by the guide columns.

A follow-on perforating device 13 is installed in the follow-on tool following the edge cutting station 12. The through-holes for the sheet metal separation pieces are there punched out. Because only one sheet metal separation piece is needed for each magnet core bundle, the hole-punching dies are activated via the packing control by a slide. An edge cutting station 14 is arranged following the follow-on perforating device 13 and is embodied substantially identical with respect to the edge cutting station 12. It can also be displaced transversely to the feed direction of the sheet metal strip 30. But it is employed for cutting the longitudinal edge of the sheet metal lamination which is to the right in the feed direction. To change the width of the sheet metal laminations it is only necessary to displace the carriages in opposite direction to each other.

A stamping unit 15 is arranged following the edge cutting station 14. It stamps depressions into one side of the sheet metal laminations. Thus, nipples are pushed out of the opposite side of the sheet metal lamination. The transverse edges, which connect the longitudinal edges, and therefore the sheet metal lamination L, are punched out in the transverse stamping presses 16 and 18. Braking magazines are arranged underneath the transverse stamping presses 16, 18. The sheet metal laminations can be pushed into these with the punching dies of the transverse stamping presses 16, 18. The required counterforce for pushing the sheet metal laminations with nipples into the depressions of the previous sheet metal laminations (packing) is generated by a braking effect in the braking magazines. As soon as the required number of sheet metal laminations is stacked on top of each other, the sheet metal separation pieces are employed. Because these do not have nipples, no connection with the lamination underneath them occurs. Thus, the sheet metal separation piece forms the first sheet metal lamination of the next magnet core bundle. The two transverse stamping presses are spatially separated from each other by an empty follow-on device 17.

Continuous monitoring takes place in a feed detection unit 20 for controlling the feeding of the follow-on tools.

The piece remaining of the sheet metal strip 30 is cut into individual pieces by a cutting device 19 at the end of the follow-on tool.

What is claimed is:

1. In a process for producing bundles of laminated sheet metal for magnet cores, wherein laminations are punched free along two longitudinal edges of a sheet metal strip, wherein at least two laminations of a magnet core have a different width extending from a first longitudinal edge to a second longitudinal edge, and wherein laminations which rest against each other are connected with each other to form the bundles, the improvement comprising:

punching the two longitudinal edges of a lamination in edge cutting stations (12, 14) which are separate from each other and are arranged offset in a feed direction of the sheet metal strip (30), the edge cutting stations (12, 14) for cutting the longitudinal edges have a cutting die (12.1) and an associated bottom die, the cutting die (12.1) and the bottom die are displaced to create different laminate widths; and punching through-holes out of the laminations for forming sheet metal separation pieces in a follow-on perforating device (13) between two of the edge cutting stations (12).

2. In the process in accordance with claim 1, wherein the cutting die (12.1) is coupled and combined with the bottom die to form a unit that is displaced.

3. In the process in accordance with claim 2, wherein the longitudinal edges of at least the two laminations are cut in the edge cutting stations.

4. In the process in accordance with claim 1, wherein the longitudinal edges of at least the two laminations are cute in the edge cutting stations.

5. In the process in accordance with claim 1, wherein the follow-on perforating device (13), in which locator holes are punched, is installed upstream of the edge cutting stations (12.1).

6. In the process in accordance with claim 1, wherein in a stamping unit (15) depressions are punched out of a predetermined number of laminations which protrude in a form of nipples on a first side of the sheet metal piece opposite a second side of the sheet metal piece which has the depressions.

7. In a process for producing bundles of laminated sheet metal for magnet cores, wherein laminations are punched free along two longitudinal edges of a sheet metal strip, wherein at least two laminations of a magnet core have a different width extending from a first longitudinal edge to a second longitudinal edge, and wherein laminations which rest against each other are connected with each other to form the bundles the improvement comprising:

punching the two longitudinal edges of a lamination in edge cutting stations (12,14) which are separate from each other and are arranged offset in a feed direction of the sheet metal strip (30), the edge cutting stations (12, 14) for cutting the longitudinal edges have a cutting die (12.1) and an associated bottom die, the cutting die (12.1) and the bottom die are displaced to create different laminate width; and punching the laminations out of the sheet metal strip (30) in the edge cutting stations (12, 14) of downstream-connected transverse stamping presses (16), wherein each of the transverse stamping presses (16) cuts a transverse edge connecting the longitudinal edges.

8. In the process in accordance with claim 7, wherein through-holes for forming sheet metal separation pieces are punched out of the laminations in a follow-on perforating device (13) between two of the edge cutting stations (12).

9. In the process in accordance with claim 8, wherein a second follow-on perforating device (11), in which locator holes are punched, is installed upstream of the edge cutting stations (12.1).

10. In the process in accordance with claim 9, wherein in a stamping unit (15) depressions are punched out of a predetermined number of laminations which protrude in a form of nipples on a first side of the sheet metal piece opposite a second side of the sheet metal piece which has the depressions.

11. In a process in accordance with claim 10, wherein the laminations are punched out of the sheet metal strip (30) in the edge cutting stations (12, 14) of downstream-connected transverse stamping presses (16), wherein the transverse stamping presses (16) each cut a transverse edge connecting the longitudinal edges.

12. In the process in accordance with claim 7, wherein the cutting die (12.1) is coupled and combined with the bottom die to form a unit that is displaced.

13.In the process in accordance with claim 7, wherein the longitudinal edges of at least the two laminations are cut in the edge cutting stations.

14. In the process in accordance with claim 7, wherein a follow-on perforating device (11), in which locator holes are punched, is installed upstream of the edge cutting stations (12.1).

15. In the process in accordance with claim 7, wherein in a stamping unit (15) depressions are punched out of a predetermined number of laminations which protrude in a form of nipples on a first side of the sheet metal piece opposite a second side of the sheet metal piece which has the depressions.

* * * * *